United States Patent [19]

Kaplowitz

[11] 4,124,213

[45] Nov. 7, 1978

[54] BOARD GAME APPARATUS

[76] Inventor: Arthur R. Kaplowitz, 34-18 76th St., Jackson Heights, N.Y. 11372

[21] Appl. No.: 804,640

[22] Filed: Jun. 8, 1977

[51] Int. Cl.[2] ..... A63F 3/00

[52] U.S. Cl. ..... 273/248; 273/288

[58] Field of Search ..... 273/248, 258

[56] References Cited

U.S. PATENT DOCUMENTS

| | | | |
|---|---|---|---|
| 715,474 | 12/1902 | Gaylor | 273/248 |
| 2,451,196 | 10/1948 | Bruck | 273/248 |
| 3,608,902 | 9/1971 | Weisbecker | 273/248 |
| 3,741,545 | 6/1973 | Weisbecker | 273/258 |
| 3,762,714 | 10/1973 | Wilson | 273/248 |

FOREIGN PATENT DOCUMENTS

| | | | |
|---|---|---|---|
| 1,413,568 | 11/1975 | United Kingdom | 273/258 |

*Primary Examiner*—Richard C. Pinkham

*Assistant Examiner*—Harry G. Strappello

*Attorney, Agent, or Firm*—Philip D. Amins

[57] ABSTRACT

A game apparatus is disclosed in which distinguishable sets of playing pieces are provided and with each player of the game receiving one of the sets for movement on the playing surface, which is divided into a grid-like array of spaces defining a path for movement of the pieces in either a horizontal or vertical direction. A plurality of corner starting zones to provide each player of the game with designated spaces for initial positioning of one of the sets therein is provided, as well as a plurality of distinguishable finishing zones to provide each player of the game with designated spaces to reach in order to win the game. A chance device is operable by players of the game apparatus for determining the possible number of spaces a particular playing piece shall move along the playing surface for movement from the starting zones to the finishing zones.

25 Claims, 4 Drawing Figures

BOARD GAME APPARATUS

BACKGROUND OF THE INVENTION

The present invention relates generally to game board apparatus and more particularly to a game in which the playing pieces have to be moved in a particular manner and to a particular area of the game board for a player to win.

The game apparatus utilizes a novel game board to provide for the players an interesting and exciting game that utilizes both skill and chance in the ability of one of the players to win the game.

OBJECTS OF THE INVENTION

An object of the present invention is to provide a new and novel board game that is exciting and may be played by youngsters as well as adults.

It is another object of the present invention to provide new and novel game board apparatus in which playing pieces are to be moved from a starting zone to a finishing zone in a specific manner as defined in the rules.

SUMMARY OF THE INVENTION

A game apparatus is disclosed in which distinguishable sets of playing pieces are provided and with each player of the game receiving one of the sets. A game board having a playing surface upon which the playing pieces are supportable is provided with the playing surface having a plurality of columns extending longitudinally of the board and each containing a plurality of spaces with laterally adjacent spaces of adjacent columns being generally aligned with each other to form a grid-like array of the spaces defining a path for movement of the pieces in either a horizontal or vertical direction.

A plurality of starting zones to provide each player of the game with designated spaces for positioning of one of the sets therein is provided. In addition, a plurality of distinguishable finishing zones to provide each player of the game with designated spaces for positioning of one of the sets therein is provided.

The finishing zones are formed in each of the respective corners of the playing surface, and the starting zones corresponding to each of the distinguishable sets are positioned adjacent each of the sides of the finishing zones. A chance device is operable by players of the game apparatus for determining the possible number of spaces a particular playing piece shall move along the playing surface for movement from one of the starting zones to one of the finishing zones.

The game board is generally square in configuration to form a generally closed figure of four sides with the finishing zones being located in the respective corners of the game board, and the starting zones being located intermediate each of the finishing zones. In the preferred embodiment of the invention the finishing zones for each one of the sets of playing pieces include at least four adjoining spaces, three of which are peripheral spaces along the sides of the game board.

Further, each one of the starting zones includes six starting spaces divided into two groups of three each, and each one of the groups extending adjacent to and along one side of one of the finishing zones. Indicia means is associated with each one of the starting zones such that they are distinguishable from each other. Preferably the indicia means are diversely colored from each other so as to readily distinguish one starting zone from another. The playing pieces and the starting zones are diversely colored the same.

Each playing piece may be in the form of a cube, and each of the sets of playing pieces for each player has provided on two faces thereof a first distinguishable respective single characteristic marking. The remaining faces of the playing pieces of each set are provided with second distinguishable respective characteristic markings of the same form. Preferably the first and second distinguishable markings are differentiated by color.

BRIEF DESCRIPTION OF THE DRAWINGS

The foregoing and other objects, features and advantages of the present invention will become readily apparent to those skilled in the art from a reading of the detailed description hereinafter, when considered in conjunction with the accompanying drawings, wherein.

DETAILED DESCRIPTION OF THE DRAWINGS

Figure 1:
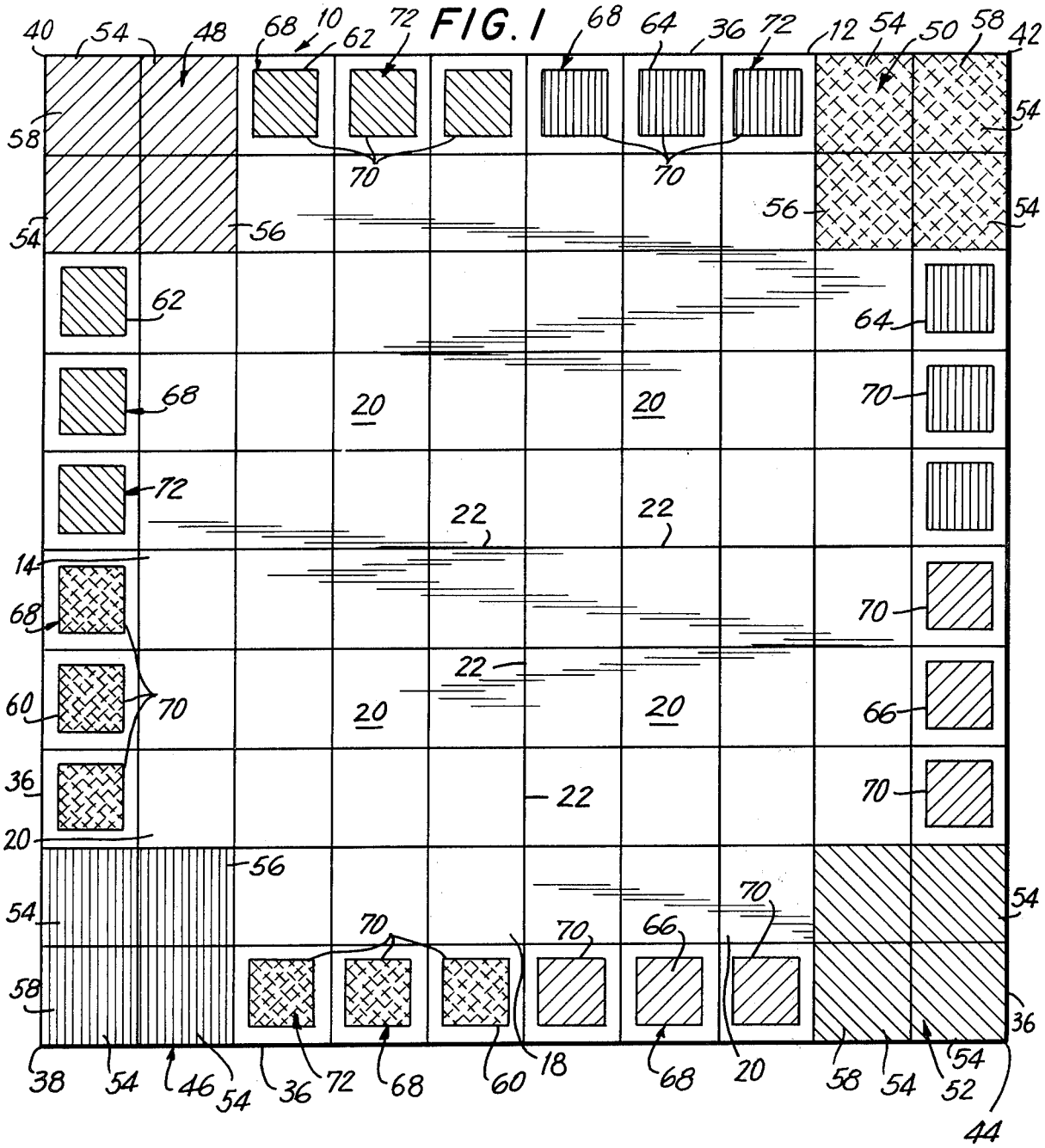
FIG. 1 is a plan view of the game board according to the present invention with certain spaces being clearly represented and the distinctive colors being indicated thereon according to the chart for draftsmen in the Patent Office Rules of Practice.

Referring to the drawings, there is illustrated in FIGS. 1 through 4 a game apparatus 10 to be played by a number of players until one of the players is the winner of the game. The game apparatus 10 comprises a game board 12 having a playing surface 14 on which distinguishable sets of playing pieces 16 are positioned and supportable during play of the game.

The playing surface 14 is divided into a plurality of columns 18, 10 being illustrated, extending longitudinally of the board 12 and each column 18 containing a plurality of spaces or squares 20. In the preferred embodiment of the playing surface 14 is divided into 100 spaces 20. In effect, the game board 12 is divided four major quadrants 22 each having an equal number, 25, of spaces 20 therein. As clearly illustrated in FIG. 1, the spaces 20 are laterally adjacent to and aligned with each other to form a grid-like array or arrangement. The spaces 20 defining a path for movement of the sets 16 of playing pieces.

Figure 2:
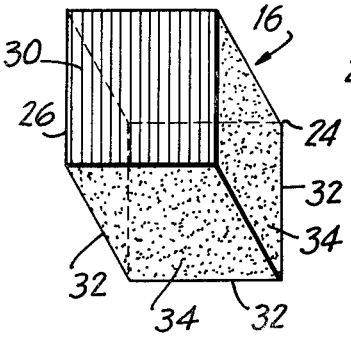
FIG. 2 is a top perspective view of a playing piece in accordance with the present invention with the surfaces thereof being clearly represented and the distinctive colors being indicated thereon according to the chart for draftsmen in the Patent Office Rules of Practice.
Figure 3:
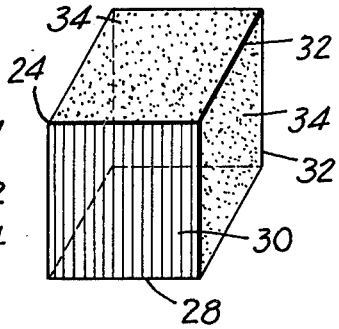
FIG. 3 is a bottom perspective view of a playing piece in accordance with the present invention with the surfaces thereof being clearly represented and the distinctive colors being indicated thereon according to the chart for draftsmen in the Patent Office Rules of Practice.
Figure 4:
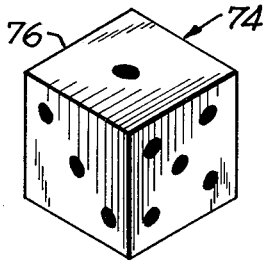
FIG. 4 is a perspective view of a die for use in association with the game of the present invention.

Each set 16 is preferably comprised of three individual playing pieces identified by numeral 24 in FIGS. 2 and 3. Although the playing piece 24 may take various forms and shapes, it is herein illustrated in the form of a cube. Two faces or surfaces 26 and 28 of the playing piece 24 are provided with first distinguishable respective single characteristic markings 30.

The remaining four faces 32 of the playing piece 24 being provided with second distinguishable respective characteristic markings 34, all of which may be in the same form. For ease in identification the first and second distinguishable markings 30 and 34, respectively, are differentiated by color. In the playing piece 24 illustrated in FIGS. 2 and 3 the opposing faces 26 and 28 have the first markings in the form of the color red and the second markings in the form of the color black.

Since the game can be played by up to four players, four sets 16 of playing pieces are provided, and each of the other sets may have the individual playing pieces appropriately color identified on faces 26 and 28. In accordance with the color sequence illustrated, these other colors may be orange, green and brown.

By having the game board 12 generally square in configuration, a closed figure having four sides 36 is formed. Further, there is defined respective corners 38, 40, 42 and 44 of the game board 12. The game apparatus 10 includes a plurality of finishing zones 46, 48, 50 and 52. Each one of the zones being associated with one of the corners 38, 40, 42 and 44 of the game board 12. Each finishing zone 46, 48, 50 and 52 is comprised of at least three adjoining peripheral spaces 54. One of the three adjoining spaces 54 forms the corner space for the respective corners 38, 40, 42 and 44 of the game board.

There may be further included an additional or fourth space 56 in each of the finishing zones 46 48, 50 and 52. In this manner the game board 12 has in each of the respective corners 38, 40, 42 and 44 finishing zones 46, 48, 50 and 52, respectively. Finishing indicia means 58 may be employed with each of the respective zones. As illustrated in FIG. 1, finishing zone 46 is identified by the color red, finishing zone 48 is identified by the color brown, finishing zone 50 is identified by the color orange, and finishing zone 52 is identified by the color green. Obviously, other colors or indicia may be selected to obtain the same end result.

There is also provided a plurality of starting zones 60, 62, 64 and 66 on which the respective sets 16 of playing pieces may be positioned. Each of the starting zones 60, 62, 64 and 66 may be divided into two groups 68, with each group consisting of three starting spaces 70. In this manner each group 68 has three starting spaces 70, extending along one side 36 of the game board 12. Since the object of the game is to have the playing pieces 24 cross the game board, as hereinafter explained in further detail, the correspondingly matched starting zones are situated diagonally across from the correspondingly matched finishing zones. For example, group 68 has starting indicia means thereon identified by numeral 72, which is illustrated as orange. The finishing zone 50 is likewise colored orange and is diagonally spaced therefrom. It will be noted that the starting zones 60, 62, 64 and 66 are disposed diametrically opposite to a corresponding one of the finishing zones 50, 52, 46 and 48, respectively.

In the manner described above the game board 12 is such that the starting indicia means 72 are diversely colored from each other so as to readily distinguish each starting zone. The playing pieces 24 are correspondingly diversely colored on the surfaces 26 and 28 thereof. In this manner each of the starting zones 60, 62, 64 and 66 includes six spaces 20 in a prearranged fashion, in tht they are each contained within a respective quadrant 22 of the game board 12.

A chance device 74 operable by the players of the game for determining the possible number of spaces 20 a particular playing piece 24 shall move along the playing surface 14 for movement from one of the starting zones 60, 62, 64 and 66 to a correspondingly coded finishing zone 46, 48, 50 and 52 is provided. The chance device 74 may take various forms and shapes and one such form being in the form of a die 76.

RULES OF PLAY

The rules of play may be contained in special instructions to provide the players with the necessary guidance in playing the game. Additional aspects of the game are identified in conjunction with the rules of play.

Set forth below are various instructions and aspects to the presnt invention which are interrelated with the structure described above in order to play the game 10 with its various aspects to it.

By having the playing board 12 divided into 10° spaces or squares 20, each player is provided with six starting positions. And preferably since only three playing pieces 24 are provided for each player, the sequence in which they are positioned is left to the individual player. It being appreciated that less than four players may play the game, and preferably a minimum of two.

Upon distribution of the playing pieces 24, each player selectively positions the playing pieces 24 in three of the six starting spaces 70. Each player can only move a playing piece 24 end over end, in either horizontal or vertical movement toward the designated corner containing the finishing zone the player is attempting to reach. The highest roll of the die 76 can determine which player goes first. A playing pice 24, must end its move with one of its two colored sides 26 and 28 facing up. At no time can a playing piece 24 be moved if there is a black side 34 facing up.

The rules of play further include that if a player rolls a one on the die 76, he must turn one of his three playing pieces 24 to a black side 34 in the space 20 that it is presently situated in. That playing piece then becomes frozen and cannot be moved until the player rolls a six on the die 76. However, the player's other pieces 24 can still be moved. Part of the interesting aspect of the game is that if a playing piece 24 is occupying a space 20, all other playing pieces 24 must move around that particular space. In this manner a player is capable of blocking the movement of the opposition.

To make the game more interesting and exciting, the rules provide that when a player is entering his or her designated finishing zone, the playing piece 24 must end with the color surfaces 26 or 28 facing up. Therefore the exact number is required on the die 76. Further, once a playing piece 24 is moved into one of the four spaces 54 or 56 of the finishing zones 46, 48, 50 and 52, then the playing piece can no longer be moved.

During travel of the playing piece 24 between the respective spaces 20, the playing piece cannot be twisted or rotated in a respective playing square 20, so as to make movement possible on any move. As described above the rules provide for a challenge to each player, and at the same time skill in selecting which playing piece 24, of the three utilized, to move. Since horizontal or vertical movement is permitted, no diagonal shortcuts can take place. This aids in the ability to block the freedom of movement of an opposing player's playing piece.

Obviously, if desired less than or more than three playing pieces can be given to each player. For example, if only two players are playing, then one may desire to have each player control four playing pieces. If four players are playing and the time of the game is to be shortened, then each player may receive one or two playing pieces. In any event, the end result is the same in that all of the playing pieces are to cross the board and become situated in the finishing zone. The player that accomplishes this first is the winner.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

What is claimed is:

1. A game apparatus comprising
distinguishable sets of playing pieces with each player of the game receiving one of said sets,
a game board having a playing surface upon which said playing pieces are supportable,
said playing surface having a plurality of columns extending longitudinally of said board and each containing a plurality of spaces with laterally adjacent spaces of adjacent columns being generally aligned with each other to form a grid-like array of said spaces defining a path for movement of said pieces in either a horizontal or vertical direction,
a plurality of starting zones to provide each player of the game with designated spaces for initial positioning of one of said sets therein,
a plurality of distinguishable finishing zones to provide each player of the game with designated spaces for final positioning of one of said sets therein,
said finishing zones being formed in each of the respective corners of said playing surface,
said starting zones corresponding to each of said distinguishable sets being positioned adjacent to each side of one of said finishing zones, and
a chance device operable by players of said game apparatus for determining the possible number of spaces a particular playing piece shall move along said playing surface for movement from a selected one of said starting zones to a selected one of said finishing zones.

2. The game board apparatus of claim 1, wherein
said playing piece is in the form of a cube.

3. The game board apparatus of claim 2, wherein
each of said sets of playing pieces for each player is provided on two faces thereof with first distinguishable respective single characteristic markings, and
said remaining faces of said playing pieces of each said set are provided with second distinguishable respective characteristic markings of the same form.

4. The game board apparatus of claim 3, wherein
said first and second distinguishable markings are differentiated by color.

5. The game board apparatus of claim 3, wherein
said chance device is a die.

6. The game board apparatus of claim 3, where
said game board is of generally square configuration to form a generally closed figure of four sides, and
said two faces of said cube are provided with said first distinguishable markings contained on oppositely disposed sides thereof.

7. The game board apparatus of claim 1, wherein
said finishing zones for each one of said sets of playing pieces include at least three adjoining peripheral spaces.

8. The game board apparatus of claim 7, wherein
said finishing spaces include a fourth space such that each one of said finishing zones is comprised of four of said finishing spaces.

9. The game board apparatus of claim 1, wherein
each one of said starting zones includes six starting spaces divided into two groups of three each, and
each one of said groups extends adjacent to and along one side of one of said finishing zones.

10. The game board apparatus of claim 1, including
starting indicia means associated with each one of said starting zones such that they are distinguishable from one another.

11. The game board apparatus of claim 10, wherein
said starting indicia means are diversely colored from one another so as to readily distinguish one of said starting zones from the other of said starting zones.

12. The game board apparatus of claim 10, including
finishing indicia means associated with each one of said finishing zones such that they are distinguishable from one another.

13. The game board apparatus of claim 12, wherein
said finishing indicia means are diversely colored from one another so as to readily distinguish one of said finishing zones from the other of said finishing zones.

14. The game board apparatus of claim 12, wherein
said playing pieces, said starting indicia means, and said finishing indicia means are diversely colored in corresponding association.

15. A game board apparatus comprising
distinguishable sets of playing pieces with each player of the game receiving one of said sets,
each of said playing pieces for each player being provided on two faces thereof with first distinguishable respective single characteristic markings,
said remaining faces of said playing pieces of each said set being provided with second distinguishable respective characteristic markings of the same form,
a game board having a playing surface upon which said playing pieces are supportable,
said game board having a substantially square configuration to form a generally closed figure of four sides,
said playing surface having a plurality of columns extending longitudinally of said board and each containing a plurality of spaces with laterally adjacent spaces of adjacent columns being generally aligned with each other to form a grid-like array of said spaces defining a path for movement of said pieces in either a horizontal or vertical direction,
a plurality of distinguishable starting zones to provide each player of the game with designated spaces for positioning of one of said sets therein,
a plurality of distinguishable finishing zones being located in the respective corners of said game board so as to provide each player of the game with designated spaces for positioning of one of said sets therein,
said finishing zones for each one of said sets of playing pieces include at least three adjoining peripheral spaces,
said starting zones corresponding to each of said distinguishable sets comprise six starting spaces divided into two groups of three each,
each of said groups being positioned adjacent to each side of one of said finishing zones, and a chance device operable by players of said game apparatus for determining the possible number of spaces a particular playing piece shall move along said playing surface for movement from one of said starting zones to a corresponding one of said finishing zones.

16. The game board apparatus of claim 15, wherein said playing surface is subdivided into 100 spaces of 10 said columns each containing 10 said spaces.

17. The game board apparatus of claim 15, including starting indicia means associated with each one of said starting zones such that they are distinguishable from one another, and said starting indicia means are diversely colored from one another so as to readily distinguish one of said starting zones from the other of said starting zones.

18. The game board apparatus of claim 17, including finishing indicia means associated with each one of said finishing zones such that they are distinguishable from one another, and said finishing indicia means are diversely colored from one another so as to readily distinguish one of said finishing zones from the other of said finishing zones.

19. The game board apparatus of claim 17, wherein said first distinguishable respective single characteristic markings of said playing pieces, said starting indicia means, and said finishing indicia means are diversely colored in corresponding association.

20. The game board apparatus of claim 15, wherein each one of said starting zones includes six starting spaces divided into two groups of three each, and each one of said groups extending adjacent to and along one side of one of said finishing zones.

21. The game board apparatus of claim 15, wherein said starting zones are disposed substantially adjacent said finishing zones.

22. The game board apparatus of claim 21, wherein said starting zones are disposed along each one of said sides of said game board.

23. The game board apparatus of claim 22, wherein said finishing zones are disposed diagonally diametrically opposite to each other in the non-adjacent corners of said game board.

24. The game board apparatus of claim 23, wherein said finishing zones are each comprised of four spaces.

25. The game board apparatus of claim 21, wherein each said corresponding one of said starting zones and said finishing zones is disposed diametrically opposite to one another.

* * * * *